US011530546B1

(12) United States Patent
Negron

(10) Patent No.: US 11,530,546 B1
(45) Date of Patent: Dec. 20, 2022

(54) MOTORIZED GARAGE EXTENSION

(71) Applicant: Ezequiel Negron, Hamden, CT (US)

(72) Inventor: Ezequiel Negron, Hamden, CT (US)

( * ) Notice: Subject to any disclaimer, the term of this patent is extended or adjusted under 35 U.S.C. 154(b) by 0 days.

(21) Appl. No.: 17/367,556

(22) Filed: Jul. 5, 2021

(51) Int. Cl.
*E04H 6/04* (2006.01)
*E04B 1/344* (2006.01)
*E04B 1/343* (2006.01)

(52) U.S. Cl.
CPC ..... *E04H 6/04* (2013.01); *E04B 1/3445* (2013.01); *E04B 1/34357* (2013.01)

(58) Field of Classification Search
CPC .. E04B 1/3442; E04B 1/3445; E04B 1/34357; E04H 6/025; E04H 6/04
See application file for complete search history.

(56) References Cited

U.S. PATENT DOCUMENTS 2,852,814 A * 9/1958 Bignardi ..... E04H 6/025 52/143
3,534,512 A * 10/1970 Ballas ..... E04H 1/12 52/143
2004/0244308 A1* 12/2004 Alusoski ..... E04H 6/04 52/64
2012/0253837 A1* 10/2012 Cashman ..... E04H 1/1205 705/2
2013/0139449 A1* 6/2013 Ho ..... E04H 1/125 52/71
2018/0043761 A1* 2/2018 May ..... E04H 15/12
2019/0330870 A1* 10/2019 May ..... E04H 6/04

FOREIGN PATENT DOCUMENTS

DE 3603118 A1 * 9/1987
EP 0130353 A2 * 1/1985

* cited by examiner

*Primary Examiner* — Christine T Cajilig
(74) *Attorney, Agent, or Firm* — The Iwashko Law Firm, PLLC; Lev Ivan Gabriel Iwashko

(57) ABSTRACT

A motorized garage extension connected to a garage and a driveway, the motorized garage extension including a plurality of walls connected to the garage to move from retracted against the garage in a first position to at least partially extended away from the garage in a second position, and move from extended away from the garage in the second position to retracted against the garage in the first position, a plurality of wall receiving tracks disposed on at least a portion of the driveway, each of the plurality of wall receiving tracks to move of at least one of the plurality of walls in response to movement of the plurality of wall receiving tracks, and a roof unit connected to at least a portion of the plurality of walls to cover at least one of the plurality of walls, the plurality of wall receiving tracks, and the driveway in an extended position, and expose at least one of the plurality of walls, the plurality of wall receiving tracks, and the driveway in a retracted position.

10 Claims, 3 Drawing Sheets

MOTORIZED GARAGE EXTENSION

BACKGROUND

1. Field

The present general inventive concept relates generally to garages, and particularly, to a motorized garage extension.

2. Description of the Related Art

Many renters and houseowners encounter the problem of not having enough space in their garage for various reasons, such as owning multiple vehicles and/or a restriction of space. Although garages are made to store vehicles, in many cases, the garage is the only place in a home and/or building that is safe to store certain house essentials and/or tools. Thus, people often use their garage for storage and leave the vehicles on the driveway.

Unfortunately, leaving the vehicles on the driveway exposes the vehicles to weather, theft, and/or other potential damage from an external source. While there are third party storage solutions, these are a recurring expense that shift the location of people's items away from the home.

Therefore, there is a need for a motorized garage extension that is easy to use and protects vehicles located on the driveway.

SUMMARY

The present general inventive concept provides a motorized garage extension.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a motorized garage extension connected to a garage and a driveway, the motorized garage extension including a plurality of walls connected to the garage to move from retracted against the garage in a first position to at least partially extended away from the garage in a second position, and move from extended away from the garage in the second position to retracted against the garage in the first position, a plurality of wall receiving tracks disposed on at least a portion of the driveway, each of the plurality of wall receiving tracks to move of at least one of the plurality of walls in response to movement of the plurality of wall receiving tracks, and a roof unit connected to at least a portion of the plurality of walls to cover at least one of the plurality of walls, the plurality of wall receiving tracks, and the driveway in an extended position, and expose at least one of the plurality of walls, the plurality of wall receiving tracks, and the driveway in a retracted position.

Each of the plurality of walls may include at least one panel, and a support frame connected to at least a portion of the garage to support the at least one panel.

Each of the plurality of wall receiving tracks may include an extraction unit disposed within the plurality of wall receiving tracks to move the at least one panel within each of the plurality of wall receiving tracks.

The roof unit may include a container body, and a covering member disposed within at least a portion of the container body to cover at least one of the plurality of walls, the plurality of wall receiving tracks, and the driveway in the extended position, and expose at least one of the plurality of walls, the plurality of wall receiving tracks, and the driveway in the retracted position.

The roof unit may further include a roof motor disposed within at least a portion of the container body and connected to the covering member to move the covering member in response to rotation of the roof motor.

The covering member and the plurality of walls may move simultaneously.

The motorized garage extension may further include a track motor connected to at least a portion of the plurality of wall receiving tracks to move the plurality of walls in response to rotation of the track motor.

The motorized garage extension may further include an operation unit including a plurality of buttons to control movement of the plurality of walls and the roof unit.

Each of the plurality of buttons may have braille text disposed thereon.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
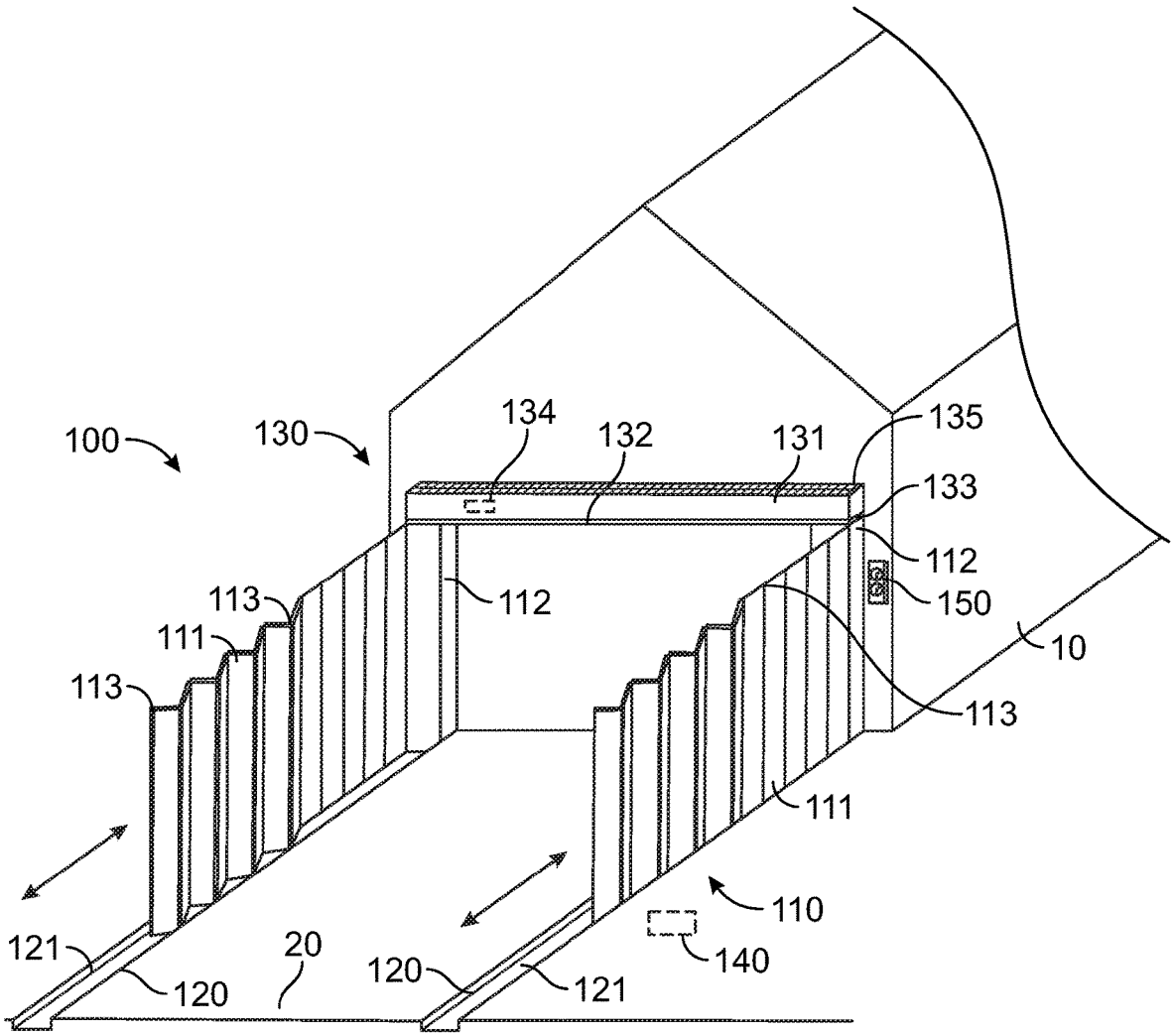
FIG. 1 illustrates a top perspective view of a motorized garage extension as disposed on a garage, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Motorized Garage Extension 100
Plurality of Walls 110
Panel 111
Support Frame 112
Fastener Receiving Aperture 113
Wall Receiving Tracks 120
Extraction Unit 121
Roof Unit 130
Container Body 131
Covering Member 132
Wall Connectors 133
Roof Motor 134
Power Source 135
Track Motor 140
Operation Unit 150
Support Beams 160

FIG. 1 illustrates a top perspective view of a motorized garage extension 100 as disposed on a garage 10, according to an exemplary embodiment of the present general inventive concept.

The motorized garage extension 100 may be constructed from at least one of metal, plastic, wood, cloth, fabric, and rubber, etc., but is not limited thereto.

The motorized garage extension 100 may include a plurality of walls 110, a plurality of wall receiving tracks 120, a roof unit 130, a track motor 140, an operation unit 150, and a plurality of support beams 160, but is not limited thereto.

Each of the plurality of walls 110 may be connected at a first end to at least a portion of a garage 10 and disposed over a surface of a driveway 20. Moreover, a first of the plurality of walls 110 may be disposed on at least a portion of a first side of the driveway 20, and a second of the plurality of walls 110 may be disposed on at least a portion of a second side of the driveway 20 opposite with respect to the first side. In other words, the driveway 20 may be disposed between each of the plurality of walls 110.

Each of the plurality of walls 110 may include at least one panel 111, a support frame 112, and at least one fastener receiving aperture 113, but is not limited thereto.

Referring to FIG. 1, the at least one panel 111 may be a single panel 111 that folds in an accordion-like manner. Alternatively, the at least one panel 111 may be a plurality of panels 111 that form at least one of the plurality of walls 110, and fold in an accordion-like manner. More specifically, a first of the plurality of panels 111 may fold in a first lateral direction, and a second of the plurality of panels 111 may fold in a second lateral direction opposite with respect to the first lateral direction. Subsequently, a third of the plurality of panels 111 may fold in the first lateral direction, and a fourth of the plurality of panels 111 may fold in the second lateral direction. Accordingly, any subsequent panel 111 may fold in likewise fashion as described above.

The support frame 112 may be connected to at least a portion of the garage 10. For example, the support frame 112 of each of the plurality of walls 110 may be connected to at least a portion of a first side and/or a second side of the garage 10. As such, the support frame 112 may support the at least one panel 111 of each of the plurality of walls 110 on the garage 10.

The at least one fastener receiving aperture 113 may be a single fastener receiving aperture 113 and/or a plurality of fastener receiving apertures 113. The at least one fastener 113 may be disposed on at least a portion of the at least one panel 111. Moreover, the at least one fastener receiving aperture 113 may receive and/or connect to a fastener therein.

Figure 2:
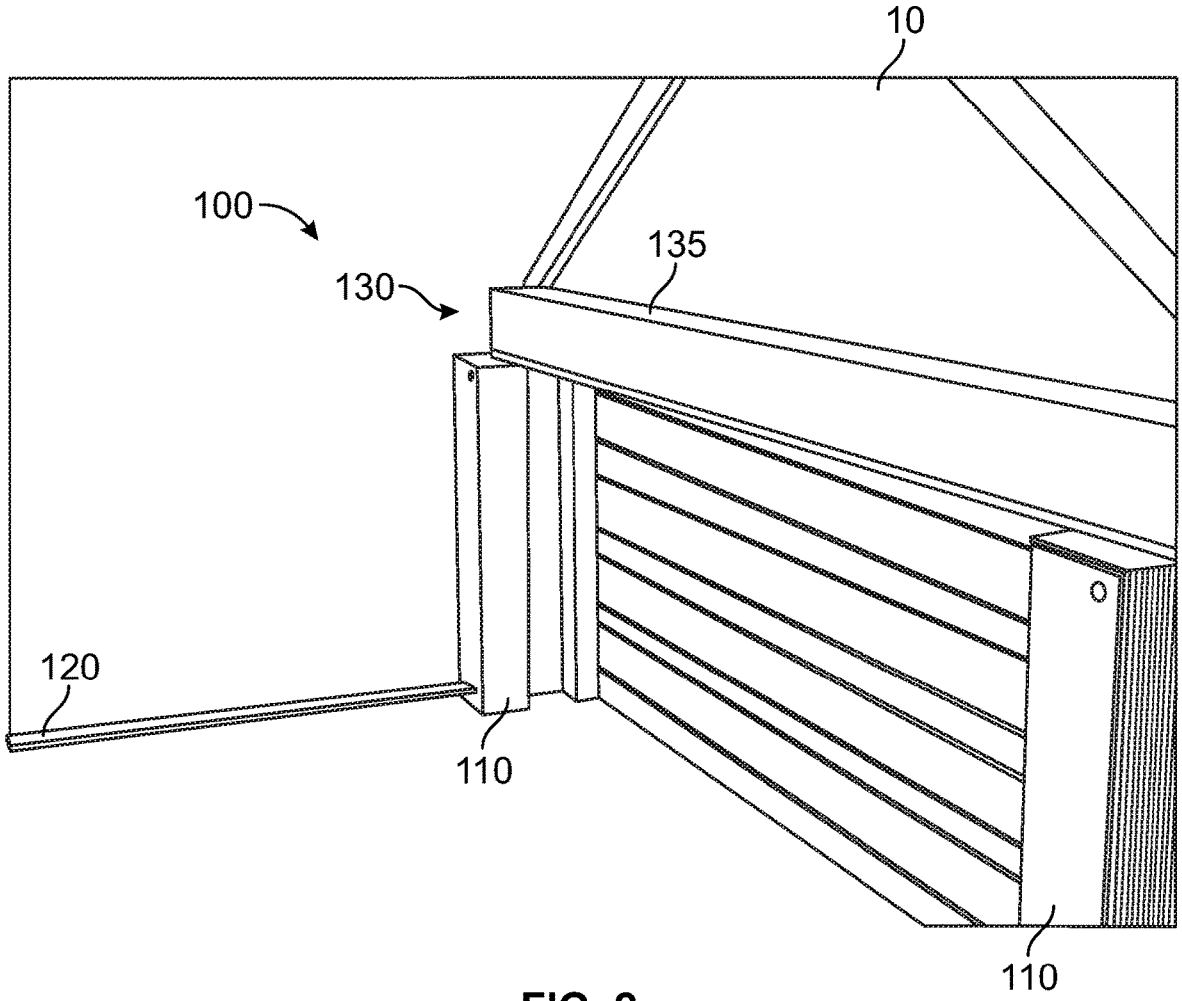
FIG. 2 illustrates a zoomed in view of the motorized garage extension as disposed on the garage in a retracted position, according to an exemplary embodiment of the present general inventive concept.

FIG. 2 illustrates a zoomed in view of the motorized garage extension 100 as disposed on the garage 10 in a retracted position, according to an exemplary embodiment of the present general inventive concept.

Figure 3:
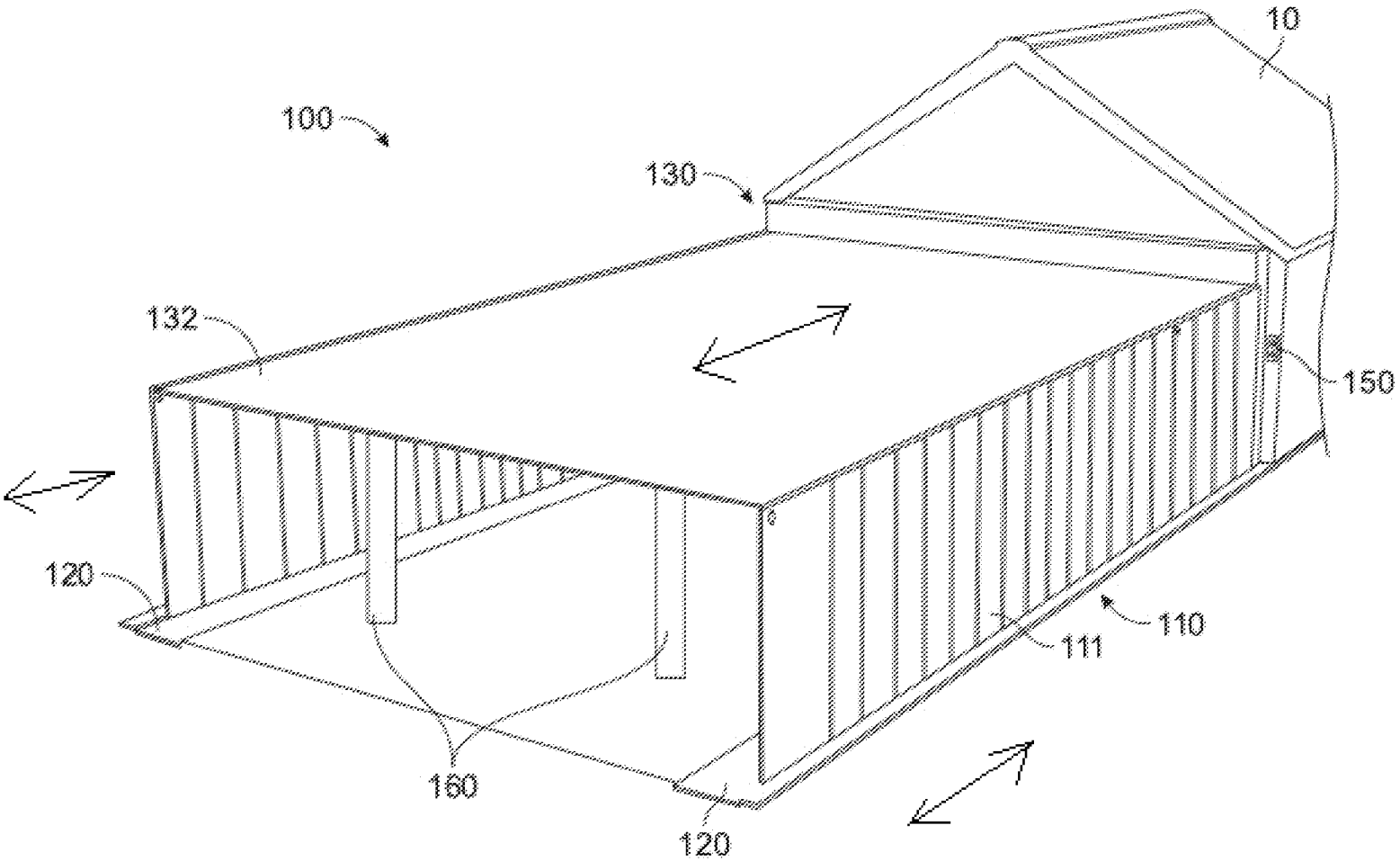
FIG. 3 illustrates a top perspective view of the motorized garage extension as disposed on the garage in an extended position, according to an exemplary embodiment of the present general inventive concept.

FIG. 3 illustrates a top perspective view of the motorized garage extension 100 as disposed on the garage 10 in an extended position, according to an exemplary embodiment of the present general inventive concept.

The plurality of wall receiving tracks 120 may be disposed on at least a portion of the driveway 20. Moreover, a first of the plurality of wall receiving tracks 120 may be disposed on at least a portion of the first side of the driveway 20, and a second of the plurality of wall receiving tracks 120 may be disposed on at least a portion of the second side of the driveway 20 opposite with respect to the first side. In other words, the driveway 20 may be disposed between each of the plurality of wall receiving tracks 120. Also, a number of the plurality of wall receiving tracks 120 may correspond to a number of the plurality of walls 110. Furthermore, the plurality of wall receiving tracks 120 may be recessed, such that the plurality of wall receiving tracks 120 may be disposed on a plane different from a plane of the driveway 20 (e.g., lower than the driveway 20).

Each of the plurality of wall receiving tracks 120 may receive and/or connect to at least one of the plurality of walls 110. Moreover, the at least one panel 111 may move (i.e. slide) within each of the plurality of wall receiving tracks 120.

Referring to FIGS. 2 and 3, the at least one panel 111 may move from retracted against the garage 10 in a first position to at least partially extended away from the garage 10 in a second position. Conversely, the at least one panel 111 may move from extended away from the garage 10 in the second position to retracted against the garage 10 in the first position.

Each of the plurality of wall receiving tracks 120 may include an extraction unit 121, but is not limited thereto.

The extraction unit 121 may include a hydraulic unit, a conveyor belt, a plurality of wheels, a chain, a magnetic rail (e.g., repel the at least one panel 111 using magnetic force), and/or any combination thereof, but is not limited thereto.

The extraction unit 121 may connect to at least a portion of the at least one panel 111. The extraction unit 121 may facilitate movement of the at least one panel 111 within each of the plurality of wall receiving tracks 120. For example, the at least one panel 111 may be connected to the hydraulic unit, the conveyor belt, the plurality of wheels, the chain, and/or the magnetic rail disposed within each of the plurality of wall receiving tracks 120, such that movement of the hydraulic unit, the conveyor belt, the plurality of wheels, the chain, and/or the magnetic rail moves the at least one panel 111.

The roof unit 130 may include a container body 131, a covering member 132, a plurality of wall connectors 133, a roof motor 134, and a power source 135, but is not limited thereto.

The container body 131 may be connected to at least a portion of the garage 10. Additionally, the container body 131 may be elongated.

The covering member 132 may be constructed of aluminum, fabric, and/or cloth, but is not limited thereto. For example, the covering member 132 may be a tarp cover.

Referring again to FIGS. 2 and 3, the covering member 132 may be disposed within at least a portion of the container body 131. Moreover, the covering member 132 may be coiled and/or rolled within the container body 131. As such, the covering member 132 may move (i.e. rotate) from retracted within the container body 131 in a first rotating position to at least partially extended away from the container body 131 in a second rotating position. Conversely, the covering member 132 may move from extended away from the container body 131 in the second rotating position to retracted within the container body 131 in the first rotating position. In other words, the container body 131 may store the covering member 132 therein. As such, the covering member 132 may cover the plurality of walls 110, the plurality of wall receiving tracks 120, and/or the driveway 20 in the extended position, and expose the plurality of walls 110, the plurality of wall receiving tracks 120, and/or the driveway 20 in the retracted position.

Furthermore, the covering member 132 may include a plurality of hooks to connect to the at least one fastener receiving aperture 113 to connect the covering member 132 to the at least one panel 111. As such, the covering member 132 may move simultaneously with the at least one panel 111 in response to movement of the at least one panel 111. Accordingly, the covering member 132 may retract and/or extend at the same time as the at least one panel 111.

Each of the plurality of wall connectors 133 may be disposed on at least a portion of a first end and/or a second end of the container body 131. The plurality of wall connectors 133 may connect the container body 131 to the support frame 112 of each of the plurality of walls 110.

The roof motor 134 may be disposed within at least a portion of the container body 131 and connected to the covering member 132. The roof motor 134 may rotate in a first direction (i.e. clockwise) or a second direction (i.e. counterclockwise) to move the covering member 132. In other words, the covering member 132 may move in response to rotation of the roof motor 134. As such, the covering member 132 may move from retracted within the container body 131 to at least partially extended away from the container body 131 in response to rotation of the roof motor 134 in the first direction or the second direction. Similarly, the covering member 132 may move from extended away from the container body 131 to retracted within the container body 131 in response to rotation of the roof motor 134 in the second direction or the first direction.

The power source 135 may include a solar cell, a battery, and a power inlet, but is not limited thereto.

The power source 135 may be disposed on at least a portion of the container body 131. The power source 135 may provide power to the plurality of wall receiving tracks 120, any portion of the roof unit 130, the track motor 140, and/or the operation unit 150.

The track motor 140 may be connected to at least a portion of the plurality of wall receiving tracks 120, such as the extraction unit 121. The track motor 140 may rotate in a first direction (i.e. clockwise) or a second direction (i.e. counterclockwise) to move the extraction unit 121. In other words, the extraction unit 121 and/or the at least one panel 111 may move in response to rotation of the track motor 140. As such, the at least one panel 111 may move from retracted against the garage 10 to at least partially extended away from the garage 10 in response to rotation of the track motor 140 in the first direction or the second direction. Similarly, the at least one panel 111 may move from extended away from the garage 10 to retracted against the garage 10 in response to rotation of the track motor 140 in the second direction or the first direction.

The operation unit 150 may include a plurality of buttons, but is not limited thereto. Also, the operation unit 150 may have braille text disposed on the plurality of buttons and/or any portion thereof to facilitate reading for people with blindness.

The operation unit 150 may be disposed and/or connected to at least a portion of the garage 10, the plurality of wall receiving tracks 120, and/or the roof unit 130. Moreover, a first of the plurality of buttons may be depressed to extend the plurality of walls 110 and/or the covering member 132. Alternatively, a second of the plurality of buttons may be depressed to retract the plurality of walls 110 and/or the covering member 132. In other words, the operation unit 150 may control movement of the plurality of walls 110 via the extraction unit 121 and the track motor 150, and/or the covering member 132 via the roof motor 134.

The plurality of support beams 160 may be removably connected to at least a portion of the covering member 132. More specifically, the plurality of support beams 160 may support a weight of the covering member 132 while the covering member 132 is in the extended position. Furthermore, the plurality of support beams 160 may be removed without use of fasteners and/or tools to expedite installation and/or removal.

Therefore, the motorized garage extension 100 may protect vehicles located on the driveway 20 by expanding a coverage area of the garage 10. Also, the motorized garage extension 100 is easy to use and can be adjusted based on a preference of a user.

The present general inventive concept may include a motorized garage extension 100 connected to a garage 10 and a driveway 20, the motorized garage extension 100 including a plurality of walls 110 connected to the garage 10 to move from retracted against the garage 10 in a first position to at least partially extended away from the garage 10 in a second position, and move from extended away from the garage 10 in the second position to retracted against the garage 10 in the first position, a plurality of wall receiving tracks 120 disposed on at least a portion of the driveway 20, each of the plurality of wall receiving tracks 120 to move of at least one of the plurality of walls 110 in response to movement of the plurality of wall receiving tracks 120, and a roof unit 130 connected to at least a portion of the plurality of walls 110 to cover at least one of the plurality of walls 110, the plurality of wall receiving tracks 120, and the driveway 20 in an extended position, and expose at least one of the plurality of walls 110, the plurality of wall receiving tracks 120, and the driveway 20 in a retracted position.

Each of the plurality of walls 110 may include at least one panel 111, and a support frame 112 connected to at least a portion of the garage 10 to support the at least one panel 111.

Each of the plurality of wall receiving tracks 120 may include an extraction unit 121 disposed within the plurality of wall receiving tracks 120 to move the at least one panel 111 within each of the plurality of wall receiving tracks 120.

The roof unit 130 may include a container body 131, and a covering member 132 disposed within at least a portion of the container body 131 to cover at least one of the plurality of walls 110, the plurality of wall receiving tracks 120, and the driveway 20 in the extended position, and expose at least one of the plurality of walls 110, the plurality of wall receiving tracks 120, and the driveway 20 in the retracted position.

The roof unit 130 may further include a roof motor 134 disposed within at least a portion of the container body 131 and connected to the covering member 132 to move the covering member 132 in response to rotation of the roof motor 134.

The covering member 132 and the plurality of walls 110 may move simultaneously.

The motorized garage extension 100 may further include a track motor 140 connected to at least a portion of the plurality of wall receiving tracks 120 to move the plurality of walls 110 in response to rotation of the track motor 140.

The motorized garage extension 100 may further include an operation unit 150 including a plurality of buttons to control movement of the plurality of walls 110 and the roof unit 130.

Each of the plurality of buttons may have braille text disposed thereon.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A motorized garage extension connected to a garage and a driveway, the motorized garage extension comprising:

a plurality of walls connected to the garage to move from retracted against the garage in a first position to at least partially extended away from the garage in a second position, and move from extended away from the garage in the second position to retracted against the garage in the first position;

a plurality of wall receiving tracks disposed on at least a portion of the driveway, each of the plurality of walls to move in response to movement of the plurality of wall receiving tracks; and a roof unit connected to at least a portion of the plurality of walls to cover at least one of the plurality of walls, the plurality of wall receiving tracks, and the driveway in an extended position, and expose at least one of the plurality of walls, the plurality of wall receiving tracks, and the driveway in a retracted position, such that the roof unit operates separately with respect to operation of the plurality of walls.

2. The motorized garage extension of claim 1, wherein each of the plurality of walls comprises:

at least one panel; and a support frame connected to at least a portion of the garage to support the at least one panel.

3. The motorized garage extension of claim 2, wherein each of the plurality of wall receiving tracks comprises:

an extraction unit disposed within the plurality of wall receiving tracks to move the at least one panel within each of the plurality of wall receiving tracks.

4. The motorized garage extension of claim 1, wherein the roof unit comprises:

a container body; and a covering member disposed within at least a portion of the container body to cover at least one of the plurality of walls, the plurality of wall receiving tracks, and the driveway in the extended position, and expose at least one of the plurality of walls, the plurality of wall receiving tracks, and the driveway in the retracted position.

5. The motorized garage extension of claim 4, wherein the roof unit further comprises:

a roof motor disposed within at least a portion of the container body and connected to the covering member to move the covering member in response to rotation of the roof motor.

6. The motorized garage extension of claim 4, wherein the covering member and the plurality of walls move simultaneously.

7. The motorized garage extension of claim 1, further comprising:

a track motor connected to at least a portion of the plurality of wall receiving tracks to move the plurality of walls in response to rotation of the track motor.

8. The motorized garage extension of claim 1, further comprising:

an operation unit including a plurality of buttons to control movement of the plurality of walls and the roof unit.

9. The motorized garage extension of claim 8, wherein each of the plurality of buttons have braille text disposed thereon.

10. A motorized garage extension connected to a garage and a driveway, the motorized garage extension comprising:

a plurality of walls connected to the garage to move from retracted against the garage in a first position to at least partially extended away from the garage in a second position, and move from extended away from the garage in the second position to retracted against the garage in the first position;

a plurality of wall receiving tracks disposed on at least a portion of the driveway, each of the plurality of walls to move in response to movement of the plurality of wall receiving tracks;

a roof unit, comprising:

a container body, a covering member disposed within at least a portion of the container body to cover at least one of the plurality of walls, the plurality of wall receiving tracks, and the driveway in the extended position, and expose at least one of the plurality of walls, the plurality of wall receiving tracks, and the driveway in the retracted position, and a roof motor disposed within at least a portion of the container body and connected to the covering member to move the covering member in response to rotation of the roof motor; and a track motor connected to at least a portion of the plurality of wall receiving tracks to move the plurality of walls in response to rotation of the track motor, such that the covering member and the roof motor move separately from movement of the plurality of walls and the track motor, respectively.

* * * * *